US006722537B1

(12) United States Patent
Houlbrook

(10) Patent No.: US 6,722,537 B1
(45) Date of Patent: Apr. 20, 2004

(54) CARTRIDGES FOR DISPENSING FLUENT MATERIAL

(75) Inventor: Kenneth Houlbrook, North Yorkshire (GB)

(73) Assignee: Clantex Limited, Leeds (GB)

( * ) Notice: Subject to any disclaimer, the term of this patent is extended or adjusted under 35 U.S.C. 154(b) by 0 days.

(21) Appl. No.: 09/980,018

(22) PCT Filed: May 22, 2000

(86) PCT No.: PCT/GB00/01927

§ 371 (c)(1),
(2), (4) Date: Apr. 22, 2002

(87) PCT Pub. No.: WO00/74865

PCT Pub. Date: Dec. 14, 2000

(30) Foreign Application Priority Data

Jun. 2, 1999 (GB) ..... 9912776

(51) Int. Cl.[7] ..... B05C 17/005

(52) U.S. Cl. ..... 222/611.1; 222/327; 222/389; 222/569; 222/575; 401/45

(58) Field of Search ..... 222/611.1, 327, 222/389, 569, 575; 401/48, 193

(56) References Cited

U.S. PATENT DOCUMENTS

| | | | | | |
|---|---|---|---|---|---|
| 3,272,393 | A | * | 9/1966 | Roeser | 222/389 |
| 3,960,294 | A | | 6/1976 | Bernard | |
| 4,182,264 | A | * | 1/1980 | Gibson et al. | 401/48 |
| 4,391,590 | A | * | 7/1983 | Dougherty | 433/90 |
| 4,505,410 | A | * | 3/1985 | Coulter | 401/48 |
| 4,508,245 | A | * | 4/1985 | Houlbrook et al. | 222/327 |
| 4,637,531 | A | | 1/1987 | Olsson | |
| 4,721,234 | A | * | 1/1988 | Spence | 222/327 |
| 4,767,326 | A | * | 8/1988 | Bennett et al. | 433/90 |
| 4,778,299 | A | * | 10/1988 | Coulter | 401/48 |
| 4,824,270 | A | | 4/1989 | Clarke | |
| 5,061,179 | A | * | 10/1991 | Dragan | 433/90 |
| 5,195,663 | A | * | 3/1993 | Martin et al. | 222/327 |
| 5,211,755 | A | * | 5/1993 | Hangley, II | 118/306 |
| 5,295,615 | A | * | 3/1994 | Gentile | 222/327 |
| 5,887,764 | A | * | 3/1999 | Ennis et al. | 222/389 |

FOREIGN PATENT DOCUMENTS

| | | |
|---|---|---|
| DE | 35 03 191 | 8/1986 |
| DE | 42 26 956 | 2/1994 |
| EP | 00765692 | 4/1997 |
| GB | 2173862 | 10/1986 |

* cited by examiner

*Primary Examiner*—Kenneth Bomberg
(74) *Attorney, Agent, or Firm*—Lowe Hauptman Gilman & Berner, LLP

(57) ABSTRACT

The invention provides a cartridge (10) for dispensing fluent materials into creases of garments to render them more permanent. The cartridge comprises a plastic elongated body (50) having an integral tongue (16) projecting laterally of the body at one end and through which the fluent composition (40) is dispensed by passing a piston (32) along the inside of the body. The tongue is a narrow member and is aligned with integral laterally projecting fins (18, 20) which fit into the crease of a garment to be rendered permanent. The tongue has a narrow rectangular bore into which fits a nozzle also having a narrow rectangular bore. The tongue bore and the nozzle bore are aligned with the fins, so as to provide maximum exactness in alignment of the body, crease and ribbon of composition which is dispensed from the nozzle. The design maximises application efficiency by ensuring registry with the crease and nozzle. The invention also discloses other aspects of the cartridge including a means for preventing refilling and an improved arrangement of a cartridge adapted so that the piston is propelled by compressed air.

16 Claims, 5 Drawing Sheets

CARTRIDGES FOR DISPENSING FLUENT MATERIAL

This invention relates to a cartridge and cartridge/nozzle combinations for dispensing fluent material into creases of garments or fabrics. The cartridge or cartridge/nozzle combination has a dispensing aperture and the fluent material is of such viscosity that a pressure is needed to cause the material to be dispensed through the dispensing aperture.

Cartridges of this type have been known for at least fifteen years, and one form of known cartridge is set forth in European Patent No. 0059413, and is used in the application of crease setting composition (which forms the fluent material) to garment creases to render them more permanent. The crease setting composition originally used typically was a synthetic resin based material which is thermosetting so that it cures when heated to render the crease more permanent, but nowadays it is more usual to use a naturally setting composition, which is still resin based. The known cartridge comprises an elongate, plastic material body which contains the resin and has a piston therein at one end of the body. At the other end, the interior communicates with a transverse bore, and into the bore is fitted (initially) a plug which prevents the resin from leaking out of the bore when the cartridge is not in use. When the cartridge is to be used, the plug is removed and is replaced by a nozzle tube which is fitted into the bore.

The nozzle tube is closed at one end, is hollow, has a hole therein communicating with the body interior, and at the other end has a nozzle outlet slit from which the resin is dispensed as a fine narrow ribbon, when pressure is applied to the piston. The pressure may be applied to the piston by mechanical means or by fluid pressure, specifically compressed air.

As the resin is dispensed, the cartridge is moved along the line of the crease of the garment, either by manual judgement, or by machine, the nozzle slit lying along the line of the crease.

When the cartridge is exhausted of resin, it is thrown away. However, it is often the case that a cartridge may be used periodically depending upon demand, and when it is not in use, but still retains some useable resin, it is stored.

The system has been successful and the components thereof have operated satisfactorily for many years, but there is now a demand for better performance, in that in attempts to prevent the resin at the nozzle outlet from hardening, for example by being left exposed to the atmosphere when stored, it has become the recommended practice to put the cartridge when stored in a cradle device so that the nozzle tip lies in a bath of oil. The oil prevents the air from coming into contact with the nozzle tip, and so prevents the residual resin in the nozzle tip from curing.

This use of oil is not really satisfactory in that the oil may be spilled if the cradle is knocked, and also there is the possibility that the oil will come into contact with the garment being treated, which can result in an undesired staining of the garment, and removal of the stain requires the use of solvent or requires dry cleaning. This is a considerable disadvantage to the person providing the permanent creasing service.

A major difficulty with the existing cartridge arrangements is the keeping of the nozzle slit in alignment with the crease and the body of the cartridge. Although various means have been tried, as these nozzles tend to be used in a rough way by operatives, it happens that the nozzle slit becomes out of alignment with crease by becoming twisted relative to the body, and the result is that the resin is not applied in the correct manner rendering the process inefficient at best and useless at worst.

Again, in some machines the cartridge is suspended to lie with the length direction extending vertically, with the cartridge free to swing to a limited extent as the garment, usually trousers, is pulled vertically past the cartridge. This swinging is needed to allow the cartridge to accommodate the widening shape of trousers from bottoms to the waistband. Conventional cartridges have not been able to operate totally effectively in such machines.

Additionally, when use is made of compressed air to force the piston along the body for the dispensing of the resin, a removable plug is placed in the end of the body to enable the connection of the air supply, and that plug must make air tight contact with the body for the driving by the compressed air to be effective. This can cause a problem, and special coupling devices are needed. These coupling devices are difficult to insert and remove properly, and operators find them difficult to work with as they are or soon become very tight.

If the piston is made from a resilient material, it is possible for the piston to deflect, allowing air to pass the piston and to make contact with the resin to be dispensed, and again this impairs efficiency.

Finally, by the use of a removable plug to form the mounting for the air supply coupling, there is the possibility that the cartridges can be refilled by removing the plug. Refilling of the cartridges is not recommended, as invariably there will be residue of resin from the first filling which may be cured, and can cause inefficiencies in cartridge operation, leading to unsatisfactory results. Also, air can become trapped in the cartridge which causes a resin quality problem, and for best results in any event a used cartridge should be cleaned before reuse.

The present invention aims to provide an improved cartridge and cartridge/nozzle combination which has/have a number of novel and inventive features which overcome the difficulties mentioned above. The cartridge is also easier to make, and is easier to use.

According to the invention there is provided, in a first aspect, a cartridge for or containing a fluent composition to be dispensed therefrom through an aperture of the cartridge, said cartridge comprising a one piece plastic moulding defining a body containing or for containing the composition having an integral dispensing nozzle the outlet of which forms the aperture of the cartridge and is in the form of a narrow slit for dispensing a ribbon of fluent composition into a crease in a garment or a fabric.

Preferably, the body is elongate and the slit extends in the direction of the length of the body.

Preferably, the nozzle is in the form of a narrow tongue projecting from the body at one end thereof.

Also, according to the invention there is provided, in a second aspect, a cartridge and nozzle combination for dispensing a fluent composition, said cartridge comprising a one piece plastic moulding defining a body containing or for containing the fluent composition and an integral tongue projecting therefrom, said tongue having a bore therethrough, said nozzle being adapted to be non rotatably received on the tongue, and comprising a sleeve portion which is adapted to be received in the tongue bore and which nozzle also has a bore passing through said sleeve portion leading to an outlet in the form of a narrow slit for dispensing a ribbon of fluent composition into a crease in a garment.

Preferably, the nozzle sleeve bore is of constant cross section in the shape of the narrow slit, and it is also preferred that the body is elongate and has the tongue at one end thereof, and the nozzle slit extends in the direction of the length of the body when the nozzle is received in the tongue.

In one arrangement, the tongue is narrower in one direction than in the other, and the tongue lies with its wide direction lying in the length direction of the body.

It is preferred that there is a range of sizes of nozzle, each having a different width of slit for the dispensing of different widths of ribbon of fluent material, and particular advantage is gamed by providing that the nozzle or each nozzle has gripping means whereby the nozzle can be gripped and removed from or inserted into the cartridge tongue.

When the nozzle is inserted in the tongue, it is preferred that its sleeve portion is in the tongue bore and the gripping means is to the outside of the tongue.

A preferred part of the invention provides that the nozzle and tongue have inter-engaging catch means to prevent the nozzle from being forced out of the tongue in use, and the catch means comprises a catch bead on at least one of the nozzle and tongue so that when the nozzle is applied the nozzle or tongue has to be snapped over the catch bead.

The cartridge may have integral guide means thereon in the form of one or more fin formations which is or are adapted to lie in the crease to which the fluent material is to be applied, and the fin formation or fin formations may be aligned with the nozzle slit when the nozzle is inserted into the tongue. Specifically, the body defines an axis extending in the length direction, and there are at least two fin formations which are spaced apart lengthwise of the body, and of which the edges which lie in the crease of the garment lie in a plane which lies at a slight angle to the said body axis. This provides that the cartridge and nozzle assembly can more easily be held stable during use. When the nozzle is inserted into the tongue, it projects further from the body than the fin formations.

To ensure best application of resin to the crease, the end of the nozzle having the slit lies at a slight angle to the body axis.

By the various features of the invention, the achievement of ensuring exact and fixed alignment of the nozzle with the body axis can be achieved, and by making the fin formations integral with the body, further alignment security is achieved. Of particular advantage is that the nozzle is of narrow shape (narrow rectangular in cross section) with a bore of constant cross section in the shape of the slit, which fits into the narrow tongue bore (of the same narrow rectangular cross section as the sleeve of the nozzle). This ensures exact alignment and avoidance of turning of the nozzle relative to the body, and the achievement of more consistently efficient operation of the process. The fin formation and design ensure more stability of the cartridge when being moved manually and ensure more consistent results in the process where the cartridge is suspended for swinging movement as discussed above, by inclining the fin formation edges relative to the body axis. The nozzle slit being held securely in alignment with the body axis, and the fin formations also being so held, provides for a most exact and controlled application of the crease setting composition, not achievable in the prior art.

Also, by providing a sleeve portion which enters the tongue of the cartridge, when the cartridge is filled with resin, the cartridge can be stored without using the oil bath, in that the nozzle bore is narrow, and the small amount of resin in the that bore can be allowed to harden (but the resin in the body of the cartridge will not), and the nozzle can simply be removed and replaced with another when the cartridge is again to be used. As an alternative, a small removable bung may be provided which is pushed into the nozzle bore when the cartridge is not in use.

According to another aspect of the invention, there is provided a cartridge comprising a plastics material body containing fluent material to be dispensed, a piston in the cartridge body at one end thereof for the dispensing of the fluent material from the other end of the body by the application of fluid under pressure on the piston, and a cap permanently sealed to the body at said one end, said cap having an integral fluid pressure connection by which the fluid pressure source can be connected to the cartridge to drive the piston.

Preferably where the cap is sealed to the body it has a stepped cross section, and the body has a corresponding stepped cross section, so that the cap and body at the sealed region fit together in an overlapping fashion, the overlapping parts being sealed together, and the stepped portion of the cap may lie to the outside or inside of the stepped portion of the body. The cap of body may additionally be held together by being screwed, bayonet or otherwise fitted together, and the parts may be additionally connected by a layer of the resin therebetween.

By permanently sealing the cap to the body, refilling is prevented, and also there is no danger of the atmosphere reaching the resin at that end of the cartridge body.

The various aspects of the invention can be used independently of one another or in any combination.

An example of a cartridge/nozzle combination embodying the various aspects of the present invention will now be described, by way of example, with reference to the accompanying drawings, wherein FIG. 1 shows a diagrammatic arrangement indicating the operation of a cartridge according to the present invention;

Figure 1:
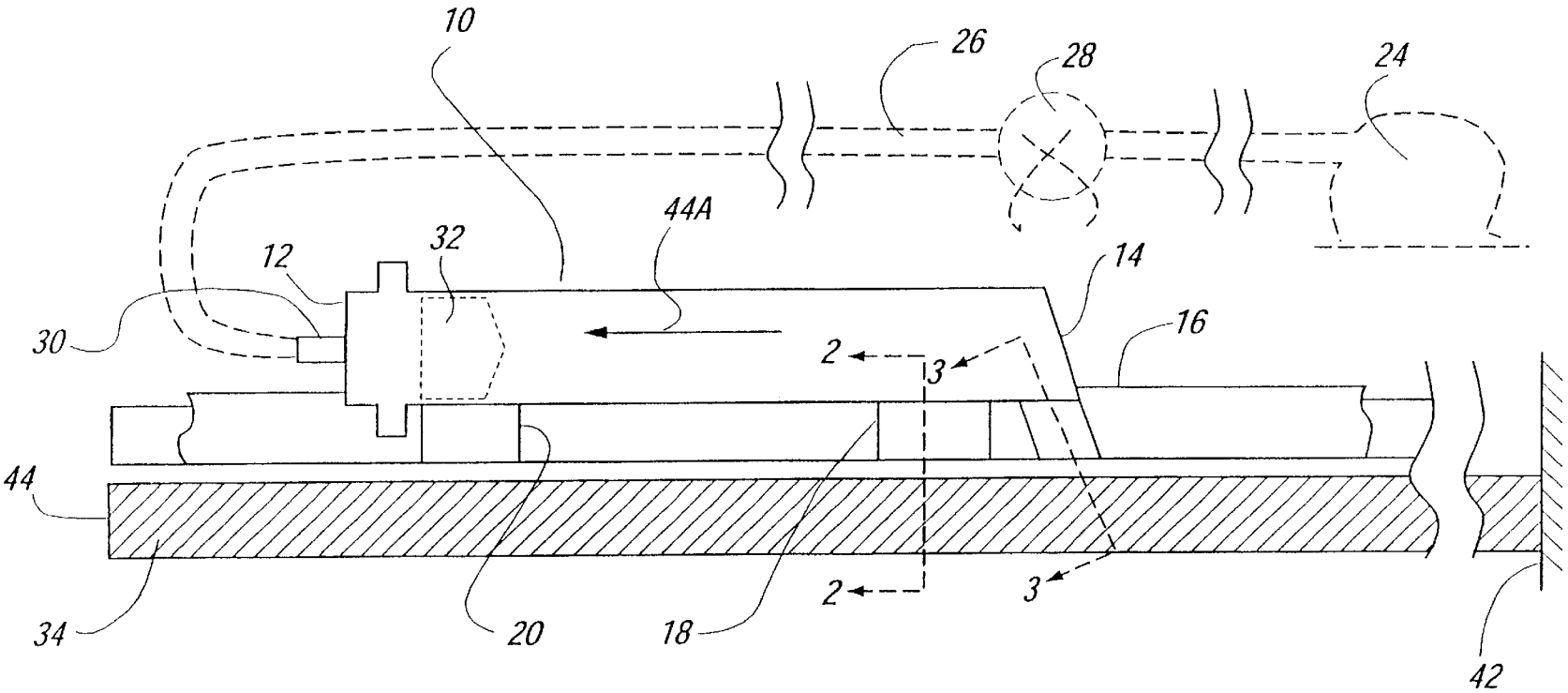

Referring to the drawings, a cartridge for dispensing crease setting composition in the form of a thermo-setting resin is indicated by reference numeral 10. The cartridge is a hollow elongate body, and in this example is of circular cross section, but it could be of other cross section as desired. The cartridge has a first end 12 which is for the reception of fluid under pressure, in this case compressed air, and a second end 14 which is the dispensing end of the cartridge, as will be clear hereinafter.

At the dispensing end, the cartridge has an integral dispensing tongue 16 which along with a pair of guide skids 18 and 20 lies in the vertical symmetrical plane 22 (FIG. 2) of the cartridge.

In FIG. 1 is shown diagrammatically a source of compressed air, for example a compressor 24 which supplies via a pipe 26 containing a control valve 28, a supply of compressed air to a coupling 30 at the first end of the cartridge. As will be explained, the compressed air is supplied to the interior of the cartridge at the first end and drives a piston 32 inside the cartridge lengthwise from the front end towards the second end. As the piston 32 is so driven, so the crease setting composition inside the cartridge is dispensed from the tongue 16 through an aperture therein.

FIG. 1 also shows a table 34 for supporting a garment 36 (FIGS. 2 and 3), a crease 38 of which is to have the crease setting composition 40 (shown in FIG. 3) applied thereto.

Although the apparatus is described as a table 34, it is in fact a long arm which is supported cantilever fashion from a fixed end 42, the other end 44 being free so that the garment can be placed thereover. The garment may typically be a pair of trousers of which the creases are to be rendered more permanent.

Figure 2:
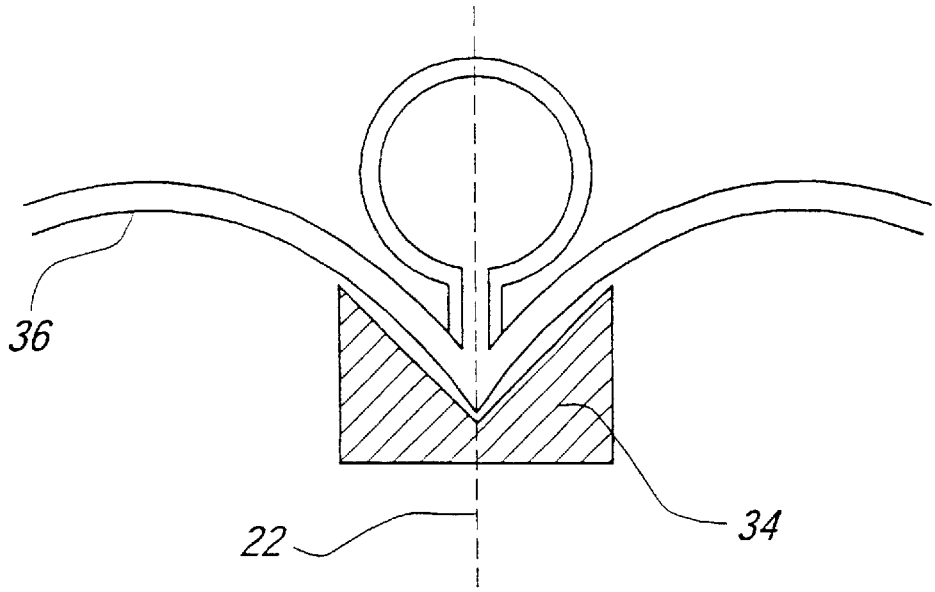
FIG. 2 is an enlarged sectional elevation taken on the line 2—2 in FIG. 1.
Figure 3:
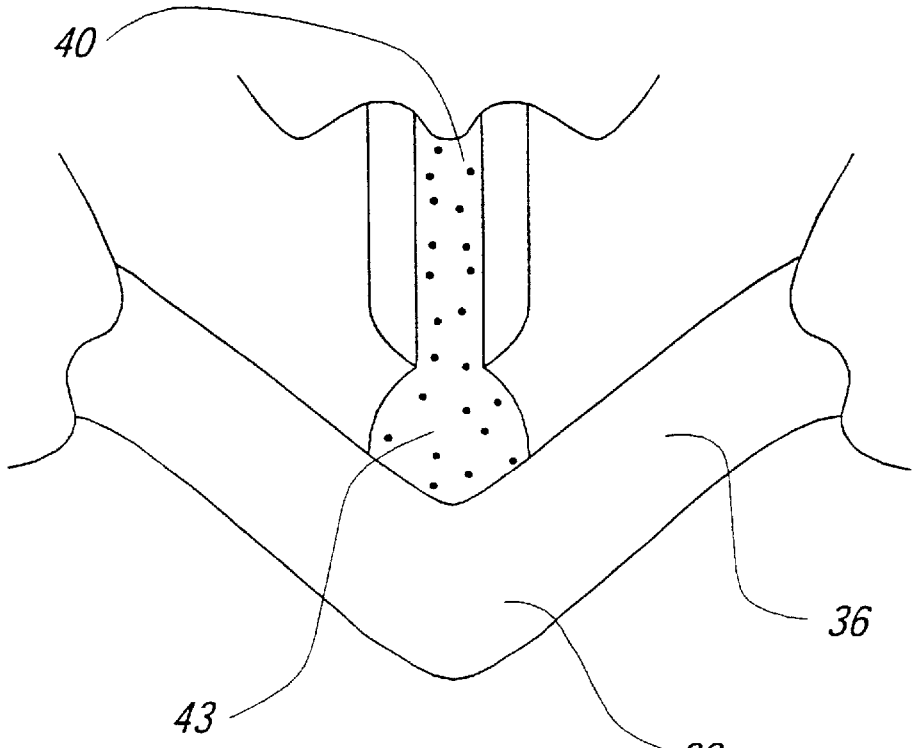
FIG. 3 is a sectional elevation to an even further enlarged scale taken on the line 3—3 in FIG. 1.

In the operation of the apparatus and cartridge the garment 36 is placed on the table 34 as illustrated in FIG. 2, and then the cartridge 10 is brought into position with the tongue 16 at the end of the garment adjacent the fixed end 42 of the table. Air under pressure is connected from the source 24 to the interior of the cartridge to cause the crease setting composition to be dispensed as shown at 43 in FIG. 3 in the form of a fine narrow ribbon into the crease 38. At the same time the operator moves the cartridge 10 as indicated by the arrow 44A in FIG. 1 along the line of the crease, and so the crease setting composition is thereby applied. The operator may control the supply of compressed air via the valve 28 which may in fact be foot operated. It could be hand operated or it could be operated by the positioning of the cartridge into the operative position, or by any other suitable means.

This basic method of operation, although not particulars of the cartridge, is known and has been practised for many years and continues to be a successful commercial operation.

Figure 4:
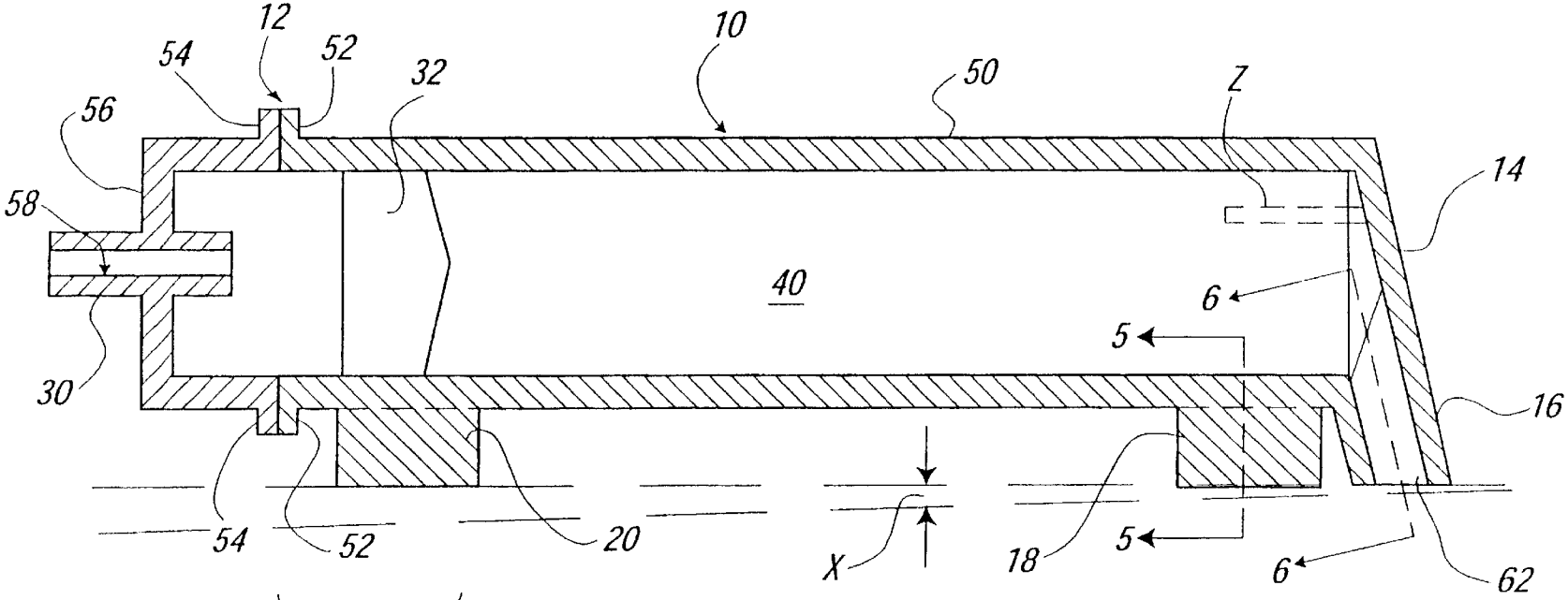
FIG. 4 is an enlarged sectional view of the cartridge shown in FIG. 1, and in accordance with a first aspect of the invention.

The present invention is concerned with the construction of the cartridge, and if reference is now made to FIG. 4, the cartridge 10 is illustrated in cross sectional elevation. It will be seen that the cartridge 10 has a body 50 and the tongue 16 is integral with the body, the body and tongue being formed in a one-piece plastics moulded component. Also integral with the body are the ski guides 18 and 20. The piston 32 is a sealing, sliding fit inside the body 10 so as to trap a quantity of crease setting composition 40 to be dispensed. FIG. 4 shows the cartridge in the full condition.

At its first end 12 the cartridge has an integral flange 52 to which is sealed a similar flange 54 of a plastic cap 56. The cap 56 also has the coupling pipe or tube 30 formed therein, and it may if required have a one-way valve 58 to prevent escape of the compressed air after it has been injected into the space behind the piston 32.

Figure 5:
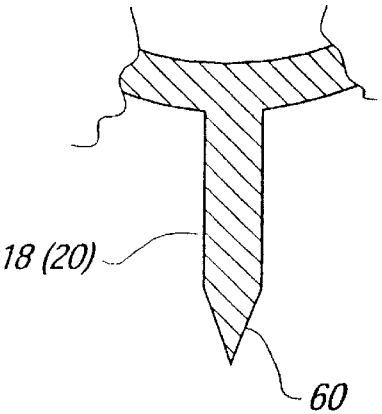
FIG. 5 is a sectional elevation to an enlarged scale taken on the line 5—5 of FIG. 1.

FIG. 5 shows that each of the skids or skis 18 and 20 is provided at its free edge with a tapered cross section 60 to ensure that the edge will fit neatly into the garment crease. These edges also determine the location of the outlet end of the tongue 16 in relation to the garment material, as in fact the dispensing of the fluent composition from the tongue 16 has to be accurately controlled. The outer edge 62 of the tongue may need to be angled at a small angle X to the horizontal (e.g. 5°) so as to give the correct deposition of the ribbon of crease setting composition which is dispensed therefrom.

Figure 6:
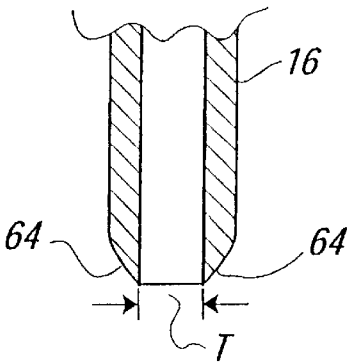
FIG. 6 is a sectional elevation to an enlarged scale taken on the line 6—6 in FIG. 4.

FIG. 6 shows the cross section of the tongue 16, and it will be seen to be hollow and comprise a passage of constant width T which controls the thickness of the narrow ribbon which is dispensed from the tongue. The thickness T will be calculated dependent upon the type of garment which is to be treated. For coarser garments such as jeans, a thicker ribbon is required whilst for the medium and largest range of weight of garments a middle thickness T is selected, whilst for lightweight and fine garments the smallest thickness T must be selected. Typically these thicknesses may be 2 mm, 1 mm and ½ mm.

At its outlet end, the tongue 16 has its edges chamfered as shown at 64 again for best fitting in the crease of the garment.

In the arrangement of FIG. 4, the tongue 16 also in fact forms a dispensing nozzle in the form of a narrow outlet slit which, in making the cartridge in one piece, is in accurate and fixed alignment with the aligned edges of the skis 18 and 20. In any event, the tongue provides an aperture through which the material can be dispensed. Inside the body 10 at the dispensing end 14 the interior defines a shallow conical surface to match the shape of the front of the piston 32 to give maximum dispensing of the material, or the piston and may be designed to the shape of the end of the bode to ensure maximum dispensing of the composition.

With the arrangement of FIG. 4, wherein the tongue 16 also forms the dispensing nozzle, it may be necessary to provide a narrow isolating plug or bung which fits into the end of the tongue to close the outlet thereof so that the material in the tongue will not harden when the cartridge is stored when not in use. Alternatively, this particular form of cartridge can be stored with the tongue 16 dipping into an oil isolating bath of known type.

The advantage of the cartridge arrangement shown in FIG. 4 is the provision of the integral tongue 16 which defines the outlet ribbon size, and it is not necessary to manufacture separate nozzles defining the ribbon size as in the conventional arrangement. Also the integral tongue and fins 20, 18 ensure fixed alignment between the crease and cartridge, and the use of two integral fins ensures excellent stability of the cartridge during use.

Figure 7:
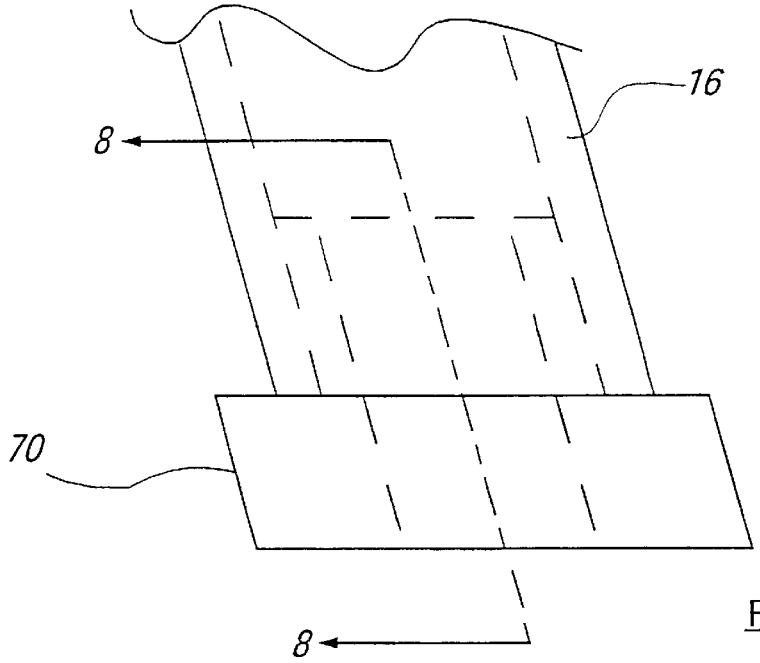
FIG. 7 is a side view showing a portion of the cartridge with a removable nozzle in accordance with a second aspect of the present invention.
Figure 8:
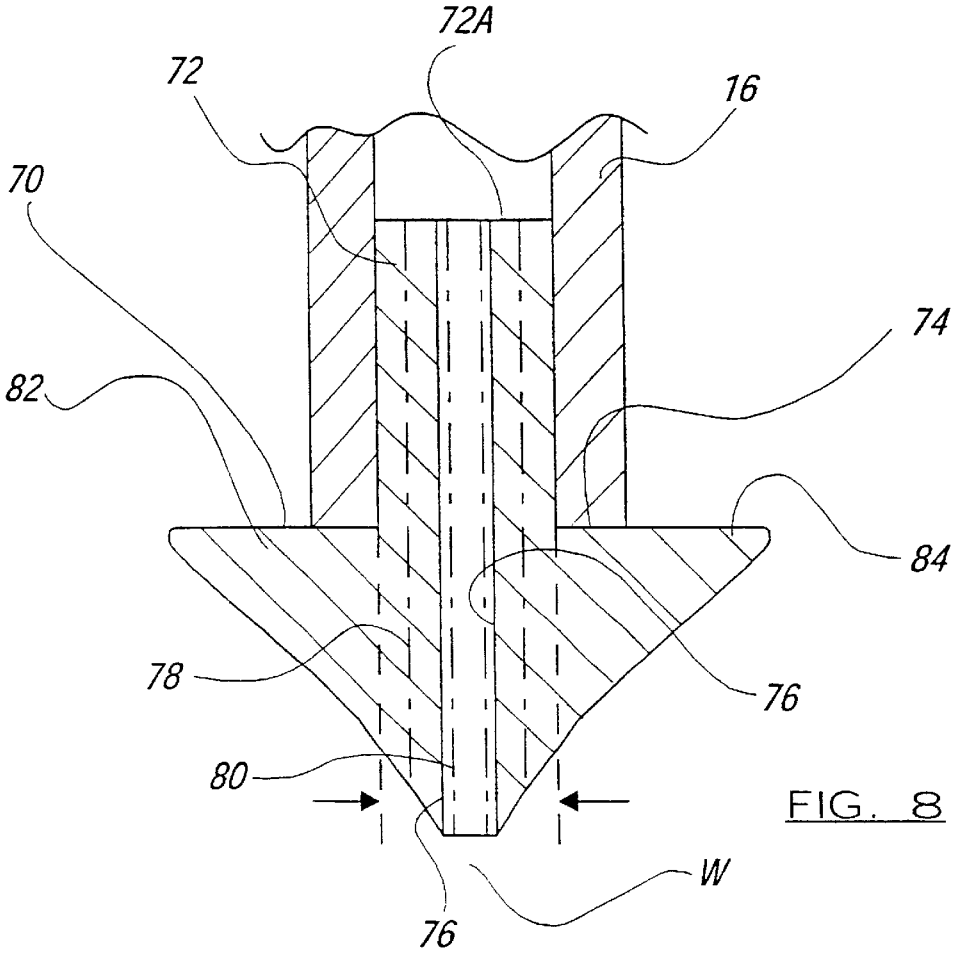
FIG. 8 is a sectional elevation taken on the line 7—7 in FIG. 7 to a very much increased scale.

FIGS. 7 and 8 however indicate another embodiment of the present invention which provides particular advantage, and referring to FIGS. 7 and 8, the tongue 16 is still provided and is shown in these figures, but in this case it will have an interior width NV as shown in FIG. 8 which is greater than the largest thickness of ribbon to be dispensed from the cartridge. To define the finished ribbon thickness, a removable nozzle 70 is applied to the outlet end of the tongue 16. The nozzle 70 as shown in FIG. 8 is of special construction, and is provided with a sleeve portion 72 which fits inside the passage of the tongue 16 basically as shown in FIG. 8, but the top 72A of the sleeve 72 preferably extends for the length of the tongue so as to lie flush with the interior of the body. The nozzle 70 forms a seal with the tongue 16 in the region 74 around the end of the tongue, and the sleeve portion 72 has a through passage 76 which forms the nozzle passage and dictates the final thickness of the ribbon which emerges from the nozzle 70. The nozzle 70 can be any of several sizes so as to define the different widths as indicated in dotted lines at 78 and 80.

As also shown in FIG. 8, the nozzle 70 has wings 82 and 84 which form finger grips whereby the nozzle can be gripped and pulled from the tongue 16. In this connection these may be inter-engaging catch means on the sleeve and tongue to ensure that the parts have to be snapped together and apart. This ensures correct connection and provides a means resisting detachment of the nozzle in use.

The advantage of using this arrangement is that the cartridge with a nozzle 70 fitted can be left standing overnight without being arranged to dip into a bath of oil because as the nozzle 70 is provided with a sleeve portion 72, there is provided a long length of narrow passage in which the material can harden, and the user simply removes the nozzle 70 with the hardened composition therein and throws it away, and inserts a new nozzle. These nozzles are small plastic items and are particularly inexpensive and therefore this is a convenient method of operation and it removes the messiness and undesirable characteristics of using a bath of oil.

In any event, there may be a separate bung for inserting into the nozzle during periods of non use.

Figures 9, 10:
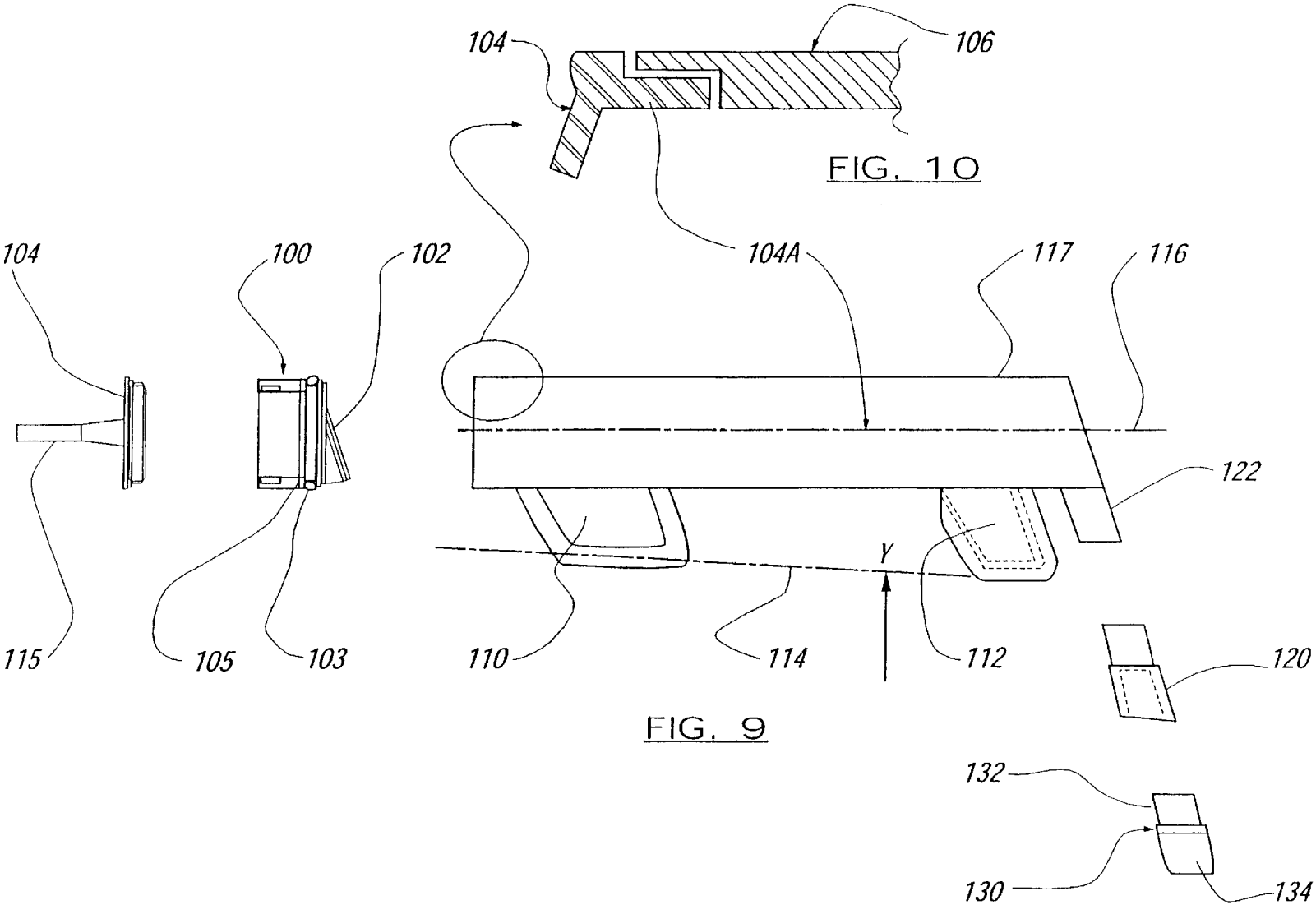
FIG. 9 is a side and exploded view, to scale, of a practical arrangement of the cartridge of FIG. 4, and the other component parts, including the nozzle of FIGS. 7 and 8.
FIG. 10 is a sectional view of the ringed detail of FIG. 9.

FIG. 9 is a to scale assembly drawing show all of the component parts of a practical example. The assembly basically comprises the arrangement of FIG. 4 but embodying the detachable nozzle arrangement of FIGS. 7 and 8, with modifications. Firstly, the piston 100 is of modified form in that it has a bevelled face 102 adapted to the shape of the bevelled end of the interior of the body, to maximise dispensing of the composition. Also, the piston has sealing ring 103 of known form which prevents compressed air from passing from the rear of the piston to the front and into contact with the resin during use. Also, in a rear recess 105 of the piston is fitted a known non-return blade spring (not shown), which does not resist forward movement of the piston, but resists reverse movement by digging into the wall of the body if any attempt is made to move the piston in the reverse direction.

Secondly, the end cap 104, which has the coupling 115 for connection to the supply of compressed air, and which is connected and sealed to the body 106 is so sealed by the means shown in FIG. 10, wherein the stepped end 104A of the cap 104 is fitted into (it could be fitted over) a corresponding stepped end 106A of the body 106, and the overlapped portions are sealed together for example by some of the resin from the cartridge (or by any suitable means), and indeed the cap and body may alternatively or additionally be connected by being screwed, bayonet fitted or otherwise connected together.

Also, the fin formations 110, 112 have their lower edges on a plane 114 which lies at a slight angle Y to the axis 116 of the body 106 of the cartridge, which enables the cartridge to be used in the vertical arrangement referred to herein. This cartridge can also be used in the conventional way, ands to this end has on the top edge, a finger depression 117 to be engaged by the finger of the operator. This improves registration at stability of operation. The nozzle 120 and the tongue 122 are designed so that the nozzle tip may lie slightly proud of the fin formations 110, 112, but angled for example at the same angle Y, so that the tip lies basically in the same inclined plane 114.

FIG. 9 additionally shows that a bung 130 can be provided. The bung 130 comprises a blade portion 132 which can be push fitted into the bore of the nozzle to seal same when not in use, and a finger grip portion 134 for gripping with the fingers to remove the bung from the nozzle when it is to be used. Clearly, the shape of the blade portion should be complimentary to the shape of the nozzle bore.

By the present invention in each of its various aspects taken alone or in combination, there is provided a particularly advantageous and novel cartridge rendering the successful crease setting application methods more convenient and even further improved.

In a modified arrangement, which is itself an independent aspect of the invention, but could be included in the embodiments set forth, there may be means for preventing refilling of the cartridge from the nozzle end. The means may take any forms and several are described and or indicated below.

In a first arrangement, inside the cartridge body is moulded a spike shown in dotted lines and indicated by the reference Z in FIG. 4, which engages the piston 32 at the end of the stroke and causes it to tilt or cockle under the air pressure. Alternatively, the spike may puncture the piston as it reaches the end of its travel. Also, the piston skirt may be perforated or may become perforated or an air passage may be created at a certain position of the piston along the body so that air can leak past the piston and out of the nozzle. This has the advantage that the cartridge will have an audible indication (the escape of air) of when the resin has been used up. The aperture prevents the refilling of the cartridge from the nozzle end. In another arrangement, the piston will be fitted with hook step or other non return means which engages the bore of the body for example in a recess or shoulder, when the piston reaches a predetermined position, preventing its return along the inside of the body. The hook means may be one or more flaps which are kept alongside the body bore until it or they reach the recess, when they spring or are forced outwards into the recess or the shoulder.

This aspect of the invention can be used with the other aspects herein set forth.

What is claimed is:

1. A cartridge and nozzle combination for dispensing a fluent composition, said cartridge comprising a one piece plastic moulding defining a body containing or for containing the fluent composition and an integral tongue projecting therefrom, said tongue having a bore therethrough, characterised in that said nozzle length a sleeve portion which is adapted to be non rotatably received in the tongue bore and which nozzle also has a bore passing through said bore leading to an outlet in the form of a narrow slit for dispensing a ribbon of fluent composition into a crease in a garment.

2. The combination according to claim 1, wherein the tongue bore is of rectangular cross section, and the sleeve outer cross section is of corresponding shape.

3. The combination according to claim 2, wherein the nozzle sleeve bore is of constant cross section in the shape of the narrow slit.

4. The combination according to claim 1, wherein the cartridge has integral guide means thereon in the form of one or more fin formations which is or are adapted to lie in the crease to which the fluent material is to be applied.

5. The combination according to claim 1, wherein the tongue is narrower in one direction than in the other.

6. The combination according to claim 5, wherein the tongue lies with its body direction lying in the length direction of the body.

7. The combination according to claim 1, wherein there is a range of sizes of nozzle, each having a different width of slit for the dispensing of different widths of ribbon of fluent material.

8. The combination according to claim 1, wherein the nozzle or each nozzle has means whereby the nozzle can be gripped and removed from or inserted into the cartridge tongue.

9. The combination according to claim 8, wherein when the nozzle is inserted in the tongue, its sleeve portion is in the tongue bore and the gripping means is to the outside of the tongue.

10. The combination according to claim 1 wherein the nozzle and tongue have inter-engaging catch means to prevent the nozzle from being forced out of the tongue in use.

11. The combination according to claim 10, wherein the catch means comprises a catch bead on at least one of the nozzle and tongue so that when the nozzle is applied the nozzle or tongue has to be snapped over the catch bead.

12. The combination according to claim 1, wherein the body is elongate and has the tongue at one end thereof, and the nozzle slit extends in the direction of the length of the body when the nozzle is received in the tongue.

13. The combination according to claim 12, wherein the fin formation or fin formation is or are aligned with the nozzle slit when the nozzle is inserted into the tongue.

14. The combination according to claim 13, wherein the body defines an axis extending in the length direction, and there are at least two fin formations which are spaced apart lengthwise of the body, and of which the edges which lie in the crease of the garment lie in a plane which lies at a slight angle to the said body axis.

15. The combination according to claim 14, wherein, when the nozzle is inserted into the tongue, it projects further from the body than the fin formations.

16. The combination according to claim 15 wherein the end of the nozzle having the slit lies at a slight angle to the body axis.

* * * * *